US007476082B2

(12) United States Patent
Vogiatzis et al.

(10) Patent No.: US 7,476,082 B2
(45) Date of Patent: Jan. 13, 2009

(54) VANE AND/OR BLADE FOR NOISE CONTROL

(75) Inventors: Costas Vogiatzis, Torrance, CA (US); Maitreya Madhyastha, Redondo Beach, CA (US); Steven Don Arnold, Rancho Palos Verdes, CA (US)

(73) Assignee: Honeywell International, Inc., Morristown, NJ (US)

( * ) Notice: Subject to any disclaimer, the term of this patent is extended or adjusted under 35 U.S.C. 154(b) by 283 days.

(21) Appl. No.: 11/209,013

(22) Filed: Aug. 22, 2005

(65) Prior Publication Data

US 2008/0260533 A1 Oct. 23, 2008

Related U.S. Application Data

(62) Division of application No. 10/430,464, filed on May 5, 2003, now Pat. No. 6,948,907.

(51) Int. Cl.
*F04D 29/30* (2006.01)

(52) U.S. Cl. ..... 416/188; 416/DIG. 2

(58) Field of Classification Search ..... None
See application file for complete search history.

(56) References Cited

U.S. PATENT DOCUMENTS

| | | | | |
|---|---|---|---|---|
| 2,029,813 | A | | 2/1936 | De Mey |
| 3,495,921 | A | | 2/1970 | Swearingen |
| 4,131,387 | A | | 12/1978 | Kazin et al. |
| 4,305,698 | A | * | 12/1981 | Sumi ..... 416/188 |
| 4,504,189 | A | | 3/1985 | Lings |
| 4,770,603 | A | | 9/1988 | Engels et al. |
| 6,042,335 | A | | 3/2000 | Amr et al. |
| 6,062,819 | A | | 5/2000 | Zangeneh et al. |
| 6,334,757 | B1 | | 1/2002 | Iwano et al. |

FOREIGN PATENT DOCUMENTS

| | | |
|---|---|---|
| JP | 10122187 A | 5/1998 |
| JP | 11257082 | 9/1999 |
| JP | 11257082 A | 9/1999 |

* cited by examiner

*Primary Examiner*—Richard Edgar

(57) ABSTRACT

Exemplary turbine blade outer edges, exemplary vane inner edges, exemplary systems and exemplary methods are disclosed that help to reduce noise in variable geometry turbines and optionally other turbines wherein a turbine blade interacts with an object. Other exemplary turbine-related technologies are also disclosed.

5 Claims, 17 Drawing Sheets

EXEMPLARY SYSTEM

EXEMPLARY TURBOCHARGER

EXEMPLARY SYSTEM

EXEMPLARY SYSTEM

WHEEL ROTATION (Θ1 TO Θ2)

$\Theta_{OVERLAP} = \Theta(P1) - \Theta(P4)$

VANE AND/OR BLADE FOR NOISE CONTROL

PRIORITY CLAIM

This U.S. patent application is a divisional application of the U.S. patent application having Ser. No. 10/430,464, filed May 5, 2003, to Vogiatzis et al. (now U.S. Pat. No. 6,948,907), which is incorporated herein by reference.

TECHNICAL FIELD

This invention relates generally to methods, devices, and/or systems for controlling noise in, for example, turbocharged and/or supercharged engines.

BACKGROUND

A boosted air system (e.g., turbocharger, supercharger, etc.), as applied to an internal combustion engine, typically introduces noise. For example, a turbocharger's compressor and/or turbine blades may generate whining noises. Such disturbances may decrease longevity of a boosted air system or other components. In addition, such disturbances may subjectively annoy people and/or animals in proximity to an operating boosted air system.

In general, noise occurs as a result of component vibrations and/or aerodynamics (e.g., acoustics). Noise associated with component vibrations may originate from various sources such as bearings. For example, bearings can experience instabilities known as "whirl". In contrast, acoustic noise typically originates from pressure fluctuations, which travel as longitudinal waves through air and/or other media.

In particular, substantial noise generation can occur due to interactions between variable geometry vanes and rotating turbine blades. Such interactions generate noise at what is commonly known as the blade pass frequency. The blade pass frequency noise is often high enough to generate customer complaints; thus, a need exists to minimize such noise.

BRIEF DESCRIPTION OF THE DRAWINGS

A more complete understanding of the various method, systems and/or arrangements described herein, and equivalents thereof, may be had by reference to the following detailed description when taken in conjunction with the accompanying drawings wherein.

DETAILED DESCRIPTION

Various exemplary devices, systems and/or methods disclosed herein address issues related to noise. For example, as described in more detail below, various exemplary devices, systems and/or methods address acoustic noise.

Figure 1:
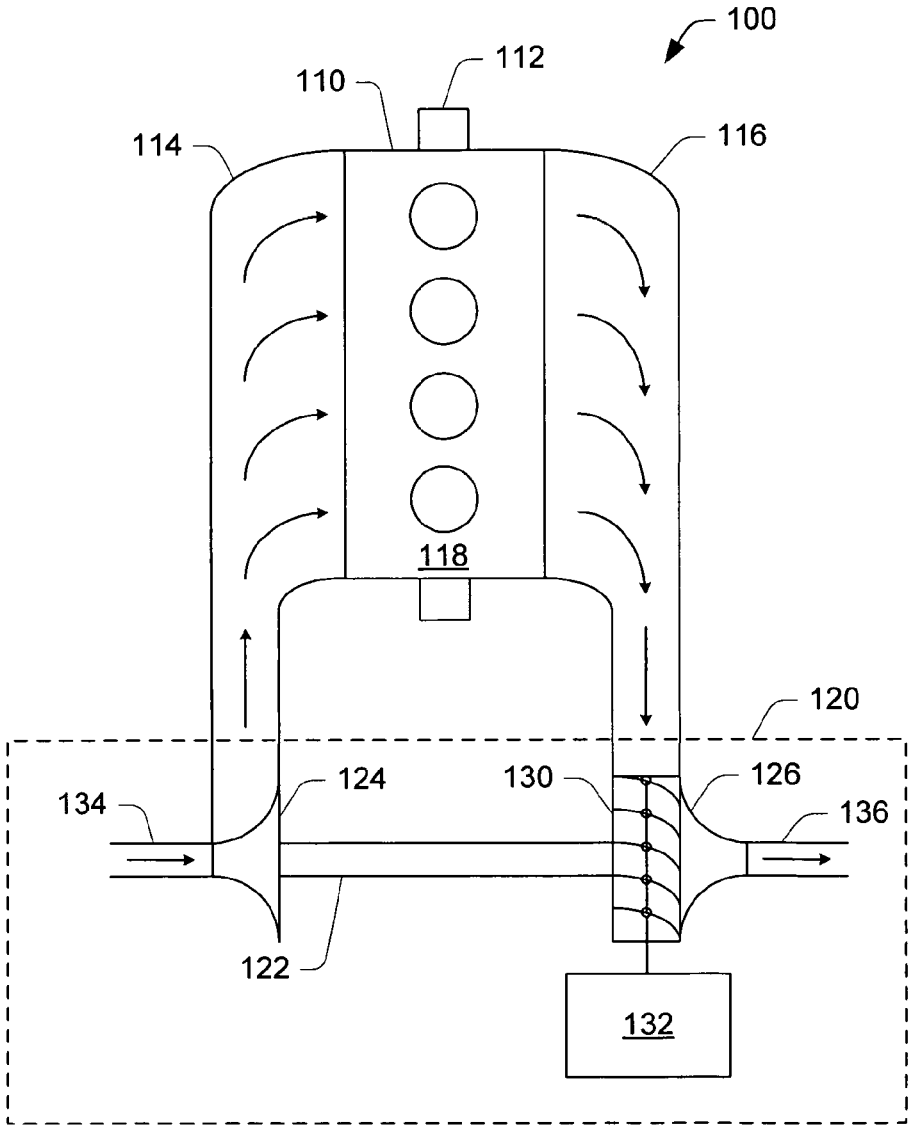
Fig. 1 (Prior Art)
FIG. 1 is a simplified approximate diagram illustrating a turbocharger with a variable geometry mechanism and an internal combustion engine.

Turbochargers are frequently utilized to increase the output of an internal combustion engine. Referring to FIG. 1, an exemplary system 100, including an exemplary internal combustion engine 110 and an exemplary turbocharger 120, is shown. The internal combustion engine 110 includes an engine block 118 housing one or more combustion chambers that operatively drive a shaft 112. As shown in FIG. 1, an intake port 114 provides a flow path for air to the engine block while an exhaust port 116 provides a flow path for exhaust from the engine block 118.

The exemplary turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor 124, a turbine 126, a variable geometry unit 130, a variable geometry controller 132 and an exhaust outlet 136. The variable geometry unit 130 optionally has features such as those associated with commercially available variable geometry turbochargers (VGTs), such as, but not limited to, the GARRETT® VNT™ and AVNT™ turbochargers, which use multiple adjustable vanes to control the flow of exhaust across a turbine.

Adjustable vanes positioned at an inlet to a turbine typically operate to control flow of exhaust to the turbine. For example, GARRETT® VNT™ turbochargers adjust the exhaust flow at the inlet of a turbine in order to optimize turbine power with the required load. Movement of vanes towards a closed position typically directs exhaust flow more tangentially to the turbine, which, in turn, imparts more energy to the turbine and, consequently, increases compressor boost. Conversely, movement of vanes towards an open position typically directs exhaust flow in more radially to the turbine, which, in turn, reduces energy to the turbine and, consequently, decreases compressor boost. Thus, at low engine speed and small exhaust gas flow, a VGT turbocharger may increase turbine power and boost pressure; whereas, at full engine speed/load and high gas flow, a VGT turbocharger may help avoid turbocharger overspeed and help maintain a suitable or a required boost pressure.

A variety of control schemes exist for controlling geometry, for example, an actuator tied to compressor pressure may control geometry and/or an engine management system may control geometry using a vacuum actuator. Overall, a VGT may allow for boost pressure regulation which may effectively optimize power output, fuel efficiency, emissions, response, wear, etc. Of course, an exemplary turbocharger may employ wastegate technology as an alternative or in addition to aforementioned variable geometry technologies.

Figure 2:
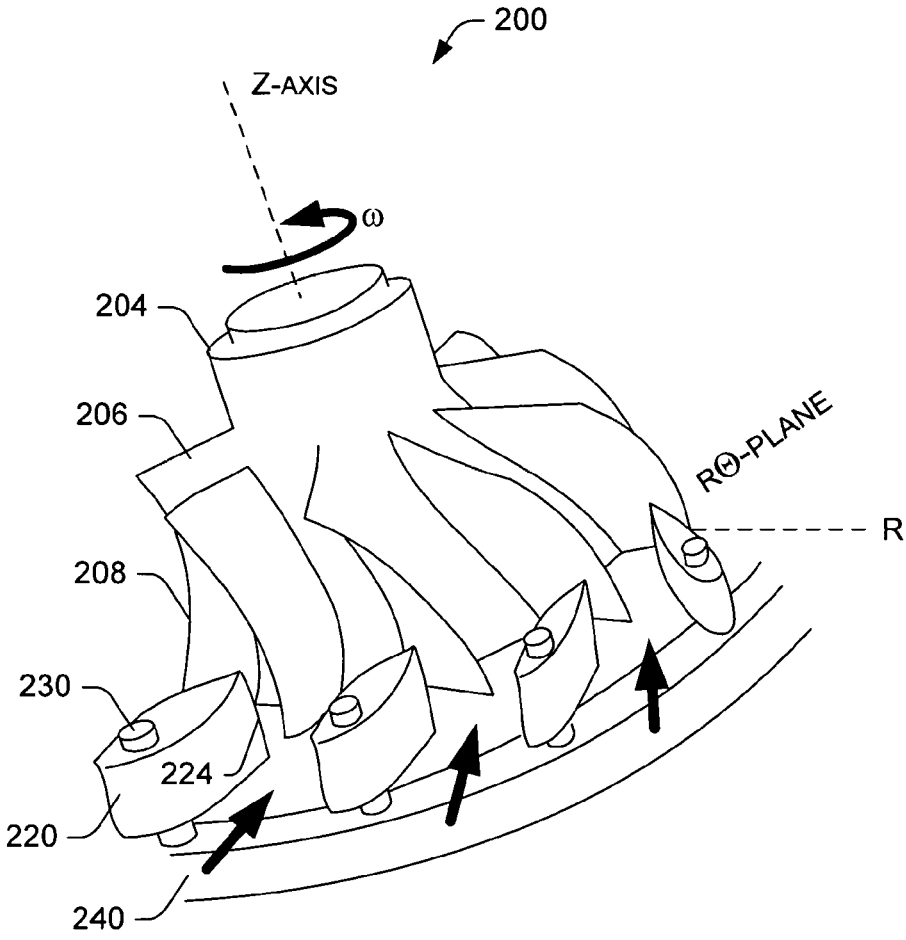
Fig. 2 (Prior Art)
FIG. 2 is an approximate perspective view of a turbine and vanes, which may be associated with a variable geometry mechanism.

FIG. 2 shows an approximate perspective view a system 200 having a turbine wheel 204 and vanes 220 associated with a variable geometry mechanism. The turbine wheel 204 is configured for counter-clockwise rotation (e.g., at an angular velocity ω about the z-axis. Of course, an exemplary system may include an exemplary turbine wheel that rotates clockwise. The turbine wheel 204 includes a plurality of blades 206 that extend primarily in a radial direction outward from the z-axis. Each of the blades 206 has an outer edge 208 wherein any point thereon can be defined in an r, Θ, z coordinate system (e.g., a cylindrical coordinate system). Further, a line formed by two or more points on an outer edge 208 may be projected normally onto a plane along the z-axis and be defined in conjunction with an angle Φ, which is formed by the intersection of the projected line and the rΘ-plane, which is the rotational plane of the turbine wheel and wherein the angle Θ=0° corresponds predominantly to direction of rotation in the rotational plane (e.g., direction of operational rotation of the turbine). For example, when viewed edge-on, the outer edge 208 of each blade 206 forms a curved 2-D projection onto a plane along the z-axis that is orthogonal to the rΘ-plane. Any two points along the curved 2-D projection may be defined with respect to an angle Φ. For example, the outer edge typically has a lowermost point (e.g., z approximately 0) wherein the angle Φ may be defined by a line tangent to the lowermost point and the rotational plane (e.g., rΘ-plane) at the lowermost point.

In this example, the vanes 220 are positioned on posts 230, which are set in a vane base 240, which may be part of a variable geometry mechanism. In this system, the individual posts 230 are aligned substantially parallel with the z-axis of the turbine wheel 204. Each individual vane 220 has an inner edge 224, which is adjustable. For example, a variable geometry mechanism can allow for rotatable adjustment of one or more inner edges 224 to alter exhaust flow to the blades 206 of the turbine wheel 204. Typically, adjustment involves adjusting the entire vane. As mentioned above, adjustments toward "open" direct exhaust flow more radially to the turbine wheel 204; whereas, adjustments toward "closed" direct exhaust flow more tangentially to the turbine wheel 204.

Figure 3A:
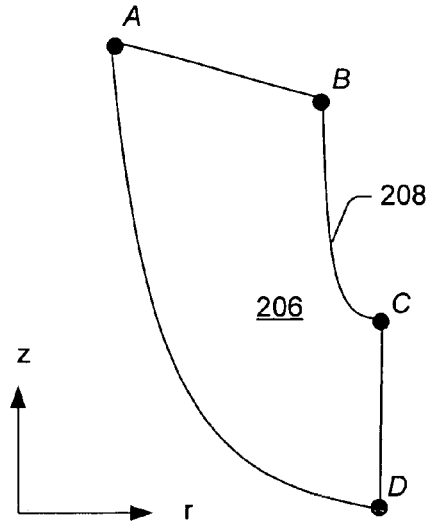
Fig. 3A (Prior Art)
FIG. 3A is a side view of a turbine blade suitable for use in the turbine of FIG. 2.

FIG. 3A shows a side view or side projection of a blade 206 of a traditional turbine wheel, such as the wheel 204 of FIG. 2. Various points, A-D, along the outer edge 208 of the blade 206 are shown. Point A represents the highest point along the z-axis wherein the blade 206 meets the hub portion of the turbine wheel. Point B is located at some radial distance from point A. Further, point B may be located at a lesser height along the z-axis when compared to point A. Point C is typically located at even greater radial distance from point A and at a lesser height along the z-axis. Point D is the lowest point of the blade outer edge 208 along the z-axis.

Figure 3B:
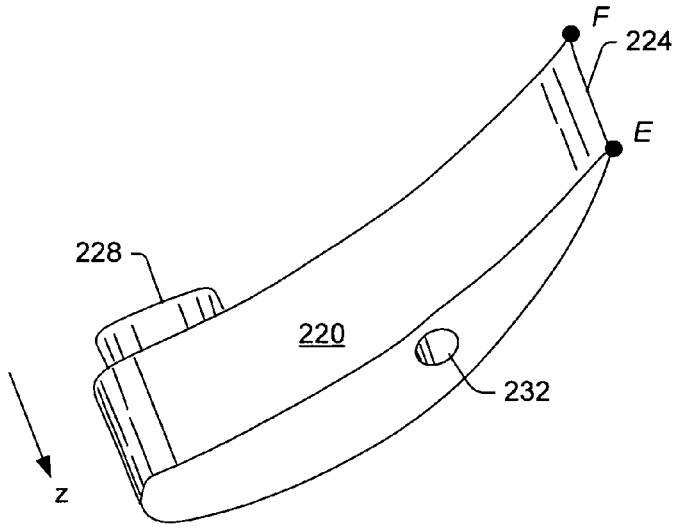
Fig. 3B (Prior Art)
FIG. 3B is a perspective view of a vane suitable for use in the turbine of FIG. 2.

FIG. 3B shows a perspective view of a vane 220 of a traditional variable geometry mechanism that employs vanes such as in the system 200 of FIG. 2. The vane has an inner edge 224 at one end and a prong 228 near an opposing end. An aperture 232 and the prong 228 typically allow for adjustment of the vane 220. The inner edge 224 has a lower point F and an upper point E, at a higher position along the z-axis. Often, the substantially rectangular surface shown is referred to as an upper or a low pressure airfoil surface while an opposing surface, not shown, is referred to as an high pressure airfoil surface. The substantially crescent shaped surfaces are referred to as an upper axial surface, shown, and a lower axial surface, not shown. The various vane surfaces are typically defined relative to vane placement with respect to a turbine wheel, as shown in FIG. 2.

As already mentioned, the vane 220 includes an inner edge 224 and an outer edge at opposite common ends of the high and low pressure airfoil surfaces. The vane includes a prong 228 or tab projecting outwardly away from the lower axial surface and positioned proximate to the outer edge. Often, such a prong is configured to cooperate with a unison ring slot to facilitate vane adjustment. In this particular traditional vane 220, the inner edge 224 (e.g., along the segment E to F), is straight and parallel to the z-axis. A vane may have an aperture or a shaft optionally along with a prong or a tab or other mechanical feature to facilitate adjustment.

Exemplary vanes described herein can be formed from the same types of materials, and in the same manner, as that used to form traditional vanes (e.g., the vane 220). Exemplary vanes may have a substantially solid design or may alternatively have a cored out design. A cored out design may provide better formability, a higher stiffness to weight ratio, be more cost effective to produce, and have a reduced mass when compared to solid vanes.

Figure 4A:
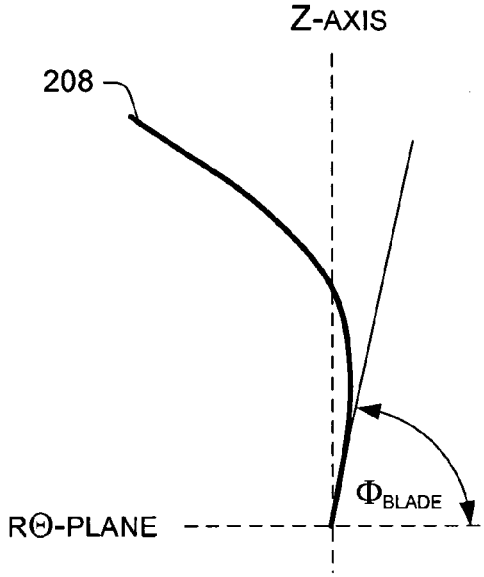
Fig. 4A (Prior Art)
FIG. 4A is a plot of a 2-D projection of an outer edge of a traditional turbine blade.

FIG. 4A shows a 2-D projection of a blade outer edge 208 of a traditional turbine wheel blade, such as that illustrated in FIG. 2. The blade outer edge 208 is shown in relation to a z-axis and an rΘ-plane (e.g., projected onto a plane along the z-axis). The z-axis corresponds to the z-axis of FIG. 2, which is the rotational axis of the turbine wheel 204. The rΘ-plane lies orthogonally to the z-axis at the lowest z value of the blade outer edge 208. As shown in FIG. 3A, the outer edge 208 of the turbine blade forms an angle $\Phi_{Blade}$ with the rΘ-plane. In a traditional turbine, the angle $\Phi_{Blade}$ is typically greater than approximately 50°.

Figure 4B:
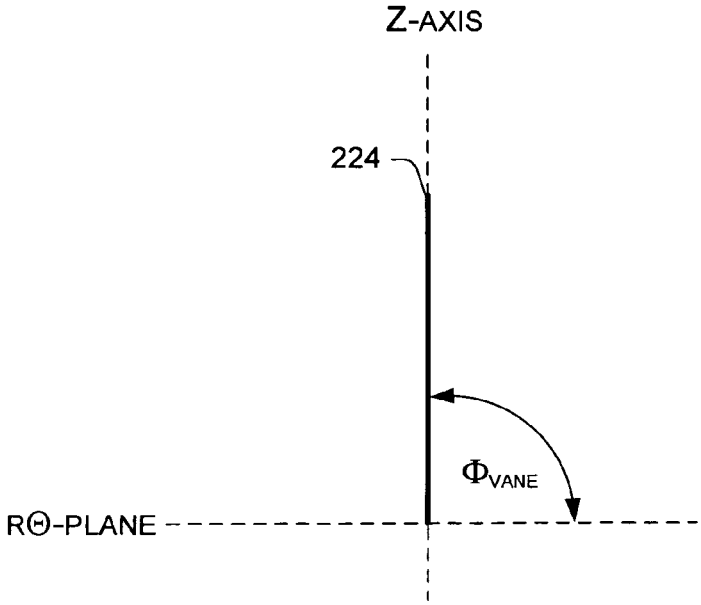
Fig. 4B (Prior Art)
FIG. 4B is a plot of a 2-D projection of an inner edge of a traditional vane.

FIG. 4B shows a 2-D projection of a vane inner edge 224 of a traditional variable geometry vane, such as that illustrated in FIG. 2. The vane inner edge 224 is shown in relation to a z-axis and an rΘ-plane (e.g., projected onto a plane along the z-axis). The z-axis corresponds to the z-axis of FIG. 2, which is the rotational axis of the turbine wheel 204. The rΘ-plane lies orthogonally to the z-axis at the lowest z value of the vane inner edge 224. As shown in FIG. 3B, the inner edge 224 of the vane forms an angle $\Phi_{Vane}$ with the rΘ-plane. In a traditional variable geometry vane, the angle $\Phi_{Vane}$ is typically approximately 90°.

Figure 5:
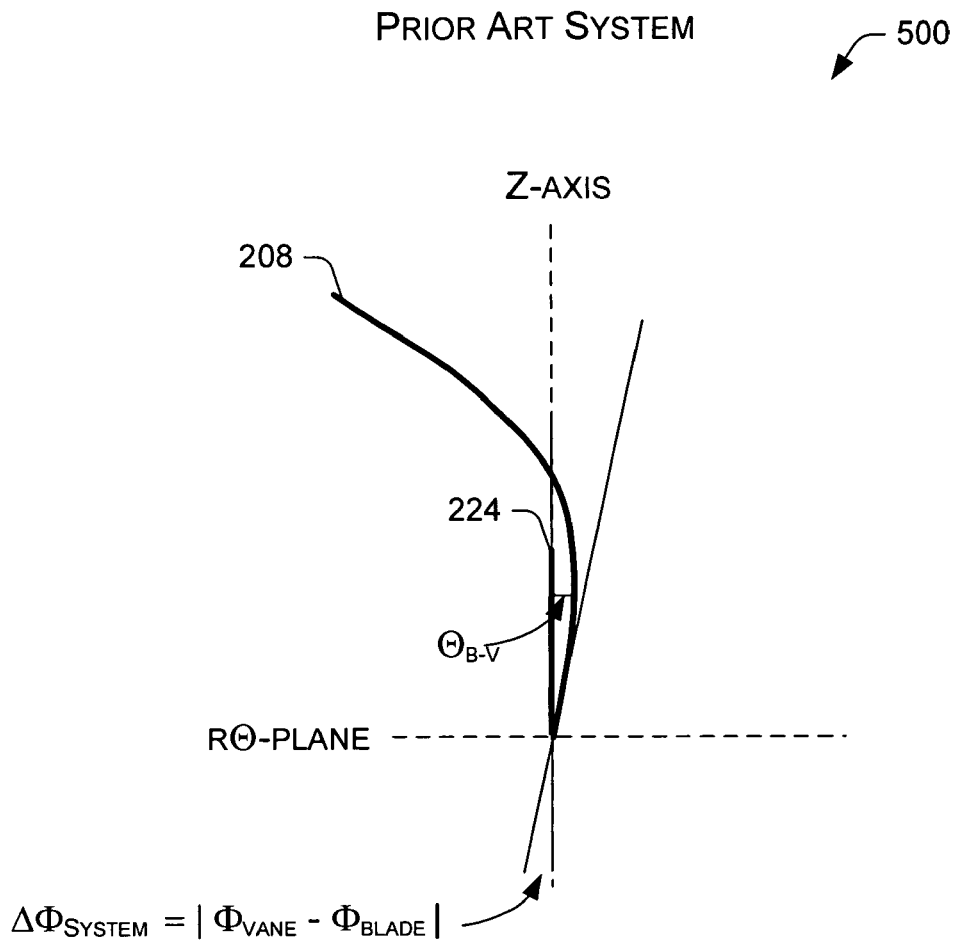
Fig. 5 (Prior Art)
FIG. 5 is a plot of the outer edge of FIG. 3A and the inner edge of FIG. 3B.

FIG. 5 shows a traditional system 500 that includes the turbine blade outer edge 208 of FIG. 4A and the variable geometry vane inner edge 224 of FIG. 4B. This particular traditional system may be characterized at least by a ΔΦ value and a $\Theta_{B\text{-}V}$ value. The value ΔΦ is given for example in degrees, as the absolute value of the difference between $\Phi_{Vane}$ and $\Phi_{Blade}$ or the inner angle defined by the blade outer edge 208 and the vane inner edge 224. Note the value ΔΦ corresponds to an angle projected onto a plane along the z-axis. The value $\Theta_{B-V}$ is given as an absolute distance (e.g., a linear distance or an arc distance) or alternatively as an angle (e.g., about the z-axis in the rΘ-plane) that corresponds to the maximum distance, or angle, of edge separation between the vane inner edge 224 and the blade outer edge 208 when the lowest z values of the vane inner edge 224 and the blade outer edge 208 lie along the same radial line about the z-axis and in the rΘ-plane. The $\Theta_{B-V}$ value may also correspond with a critical point of the blade outer edge 208 (e.g., where the outer edge of the blade, as projected, begins to sweep from forward to backward, which may also be shown in a plot of wrap angle versus blade height). Further, the value $\Theta_{B-V}$ is a static blade and vane system parameter that may approximate $\Theta_{Overlap}$, which is dynamic blade and vane system parameter discussed below. The angle $\Theta_{B-V}$ may be approximated by an angle formed between a blade leading radial line and a vane leading radial line upon alignment of the blade trailing radial line and the vane trailing radial line (e.g., see FIG. 12A for a top view of an exemplary system). $\Theta_{Overlap}$ represents an angle of rotation of a turbine wheel blade about its axis wherein at least one point on the outer edge of the blade and at least one point on an inner edge of a corresponding vane overlap.

The traditional system 500 shown in FIG. 5 helps to demonstrate a major source of acoustic noise. As the blade outer edge 208 rotates in Θ about the z-axis, it encounters each "stationary" vane inner edge 224. As the turbine wheel rotates, the blade outer edge 208 passes the vane inner edge 224 and pressure disturbances are imparted to the exhaust. The characteristics of the pressure disturbances are, in part, related to the ΔΦ value and the $\Theta_{B-V}$ value of the system. Further, during overlap between a vane inner edge and a blade outer edge, an interaction point or points may be defined and such point or point may have a corresponding speed. As discussed herein, such a speed may be related to characteristics of pressure disturbances, noise, etc.

In general, the magnitude of the pressure disturbances is inversely related to the ΔΦ value and/or the $\Theta_{B-V}$ value of the system. In other words, for a given speed of rotation of a turbine wheel, a small ΔΦ value will typically result in a quick and abrupt interaction between the blade outer edge 208 and the vane inner edge 224; similarly, a small $\Theta_{B-V}$ value will result in a quick and abrupt interaction between the blade outer edge 208 and the vane inner edge 224.

A small ΔΦ value of a traditional system is typically less than or equal to approximately 40°. For example, if $\Phi_{Blade}$=50° and $\Phi_{Vane}$=90°, then ΔΦ=40°. A small $\Theta_{B-V}$ value is typically less than or equal to approximately 6°. Various exemplary blades, vanes and/or systems described herein generally use or result in larger ΔΦ and/or $\Theta_{B-V}$ values and act to reduce noise. Various exemplary blades, vanes and/or systems may also be characterized in terms of overlap of a blade outer edge and a vane inner edge with respect to turbine wheel rotation, which is discussed below, for example, with reference to the dynamic blade and vane system parameter $\Theta_{Overlap}$. Yet further, various exemplary blades, vanes and/or systems may be characterized in terms of an interaction point speed.

Figure 6A:
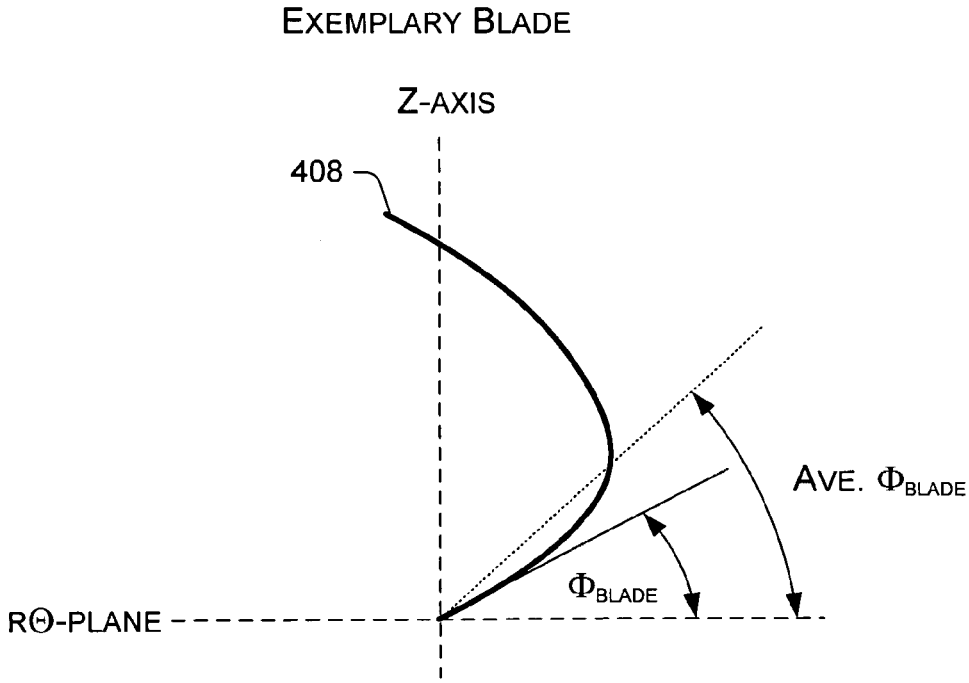
FIG. 6A is a plot of a 2-D projection of an outer edge of an exemplary turbine blade.

FIG. 6A shows a 2-D projection of an exemplary blade outer edge 408 of a turbine wheel blade, suitable for use in the system illustrated in FIG. 2. The blade outer edge 408 is shown in relation to a z-axis and an rΘ-plane (e.g., projected onto a plane along the z-axis). The z-axis corresponds to the z-axis of FIG. 2, which is the rotational axis of the turbine wheel 204. The rΘ-plane lies orthogonally to the z-axis at the lowest z value of the exemplary blade outer edge 408. As shown in FIG. 6A, the outer edge 408 of the turbine blade forms an angle $\Phi_{Blade}$ with the rΘ-plane. While in a traditional turbine, the angle $\Phi_{Blade}$ is typically greater than approximately 50°, in this particular exemplary turbine blade, the angle $\Phi_{Blade}$ is less than approximately 50°. In another exemplary turbine blade, the angle $\Phi_{Blade}$ is less than approximately 50° and greater than approximately 5°. In yet another exemplary turbine blade, the angle $\Phi_{Blade}$ is less than or equal to approximately 45° and greater than or equal to approximately 5°.

If a blade has an initial angle that does not approximate an average angle (not shown), for example, an angle defined by a line passing between the lowest z value of the outer edge of the blade and a critical point on the outer edge of the blade (which may define a leading radial line as discussed below), then the angle $\Phi_{Blade}$ may also be defined by this average angle (see, e.g., the angle "Ave. $\Phi_{Blade}$" shown in FIG. 6A where the initial angle approximates the average angle). While, in general, the initial angle suffices for characterizing exemplary blades discussed herein, other exemplary blade may be characterized using an average angle. While in a traditional turbine, the angle Ave. $\Phi_{Blade}$ is typically greater than approximately 60°, in this particular exemplary turbine blade, the angle $\Phi_{Blade}$ is less than approximately 60°. In general, an Ave. $\Phi_{Blade}$ is greater than a corresponding $\Phi_{Blade}$.

Figure 6B:
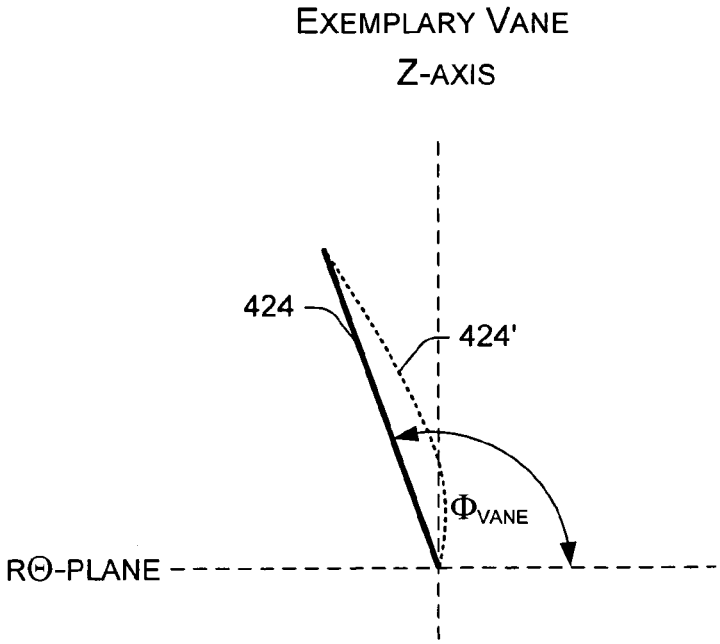
FIG. 6B is a plot of a 2-D projection of an inner edge of an exemplary vane.

FIG. 6B shows a 2-D projection of an exemplary vane inner edge 424 of a variable geometry vane, suitable for use in the system illustrated in FIG. 2. The exemplary vane inner edge 424 is shown in relation to a z-axis and an rΘ-plane (e.g., projected onto a plane along the z-axis). The z-axis corresponds to the z-axis of FIG. 2, which is the rotational axis of the turbine wheel 204. The rΘ-plane lies orthogonally to the z-axis at approximately the lowest z value of the exemplary vane inner edge 424. As shown in FIG. 6B, the inner edge 424 of the vane forms an angle $\Phi_{Vane}$ with the r®-plane. While in a traditional variable geometry vane, the angle $\Phi_{Vane}$ is approximately 90°, in this exemplary vane, the angle $\Phi_{Vane}$ is greater than approximately 90°. In another exemplary vane, the angle $\Phi_{Vane}$ is greater than approximately 100°. In yet another exemplary turbine, the angle $\Phi_{Vane}$ is greater than or equal to approximately 117°.

If a vane has an initial angle that does not approximate an average angle, for example, an angle defined by a line passing between the lowest z value of the inner edge of the vane and the highest z value of the inner edge of the vane, then the angle $\Phi_{Vane}$ may also be defined by this average angle. The dashed line labeled 424' represents an instance where the inner edge of a vane is curved or arcuate and where the inner edge has an initial angle that does not approximate the average angle. In this instance, the angle $\Phi_{Vane}$ may be defined by the average angle.

Figure 7:
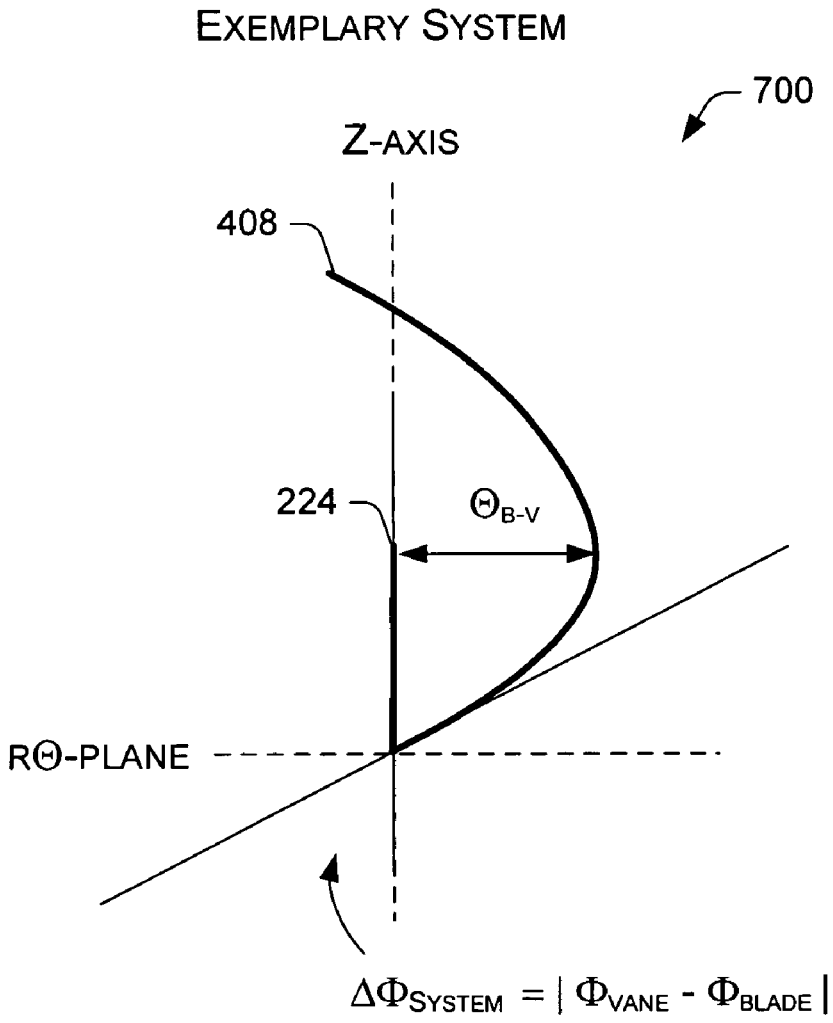
FIG. 7 is a plot of the exemplary outer edge of FIG. 6A and the traditional inner edge of FIG. 4B.

FIG. 7 shows an exemplary system 700 that includes an exemplary blade having an outer edge 408 and a traditional vane having an inner edge 224, which are suitable for use in an arrangement such as that illustrated in FIG. 2. The blade outer edge 408 is shown in relation to a z-axis and an rΘ-plane (e.g., projected onto a plane along the z-axis). The z-axis corresponds to the z-axis of FIG. 2, which is the rotational axis of the turbine wheel 204. The rΘ-plane lies orthogonally to the z-axis at the lowest z value of the exemplary blade outer edge 408. As shown in FIG. 7, the outer edge 408 of the turbine blade forms an angle $\Phi_{Blade}$ with the rΘ-plane (e.g., projected onto a plane along the z-axis). In the exemplary system 700, the angle $\Delta\Phi_{System}$ is typically greater than approximately 40°. For example, given a $\Phi_{Blade}$ value of 45° and a $\Phi_{Vane}$ value of approximately 90°, $\Delta\Phi_{System}$ would be approximately 45°, which is greater than 40°. Further, the $\Theta_{B-V}$ value of this example system is approximately 26°, which is greater than 6°. In addition, the outer edge of the exemplary blade has a lowermost point and a critical point wherein the lowermost point and the critical point are separated by at least approximately 6° in the rotational plane (e.g., rΘ-plane).

Figure 8:
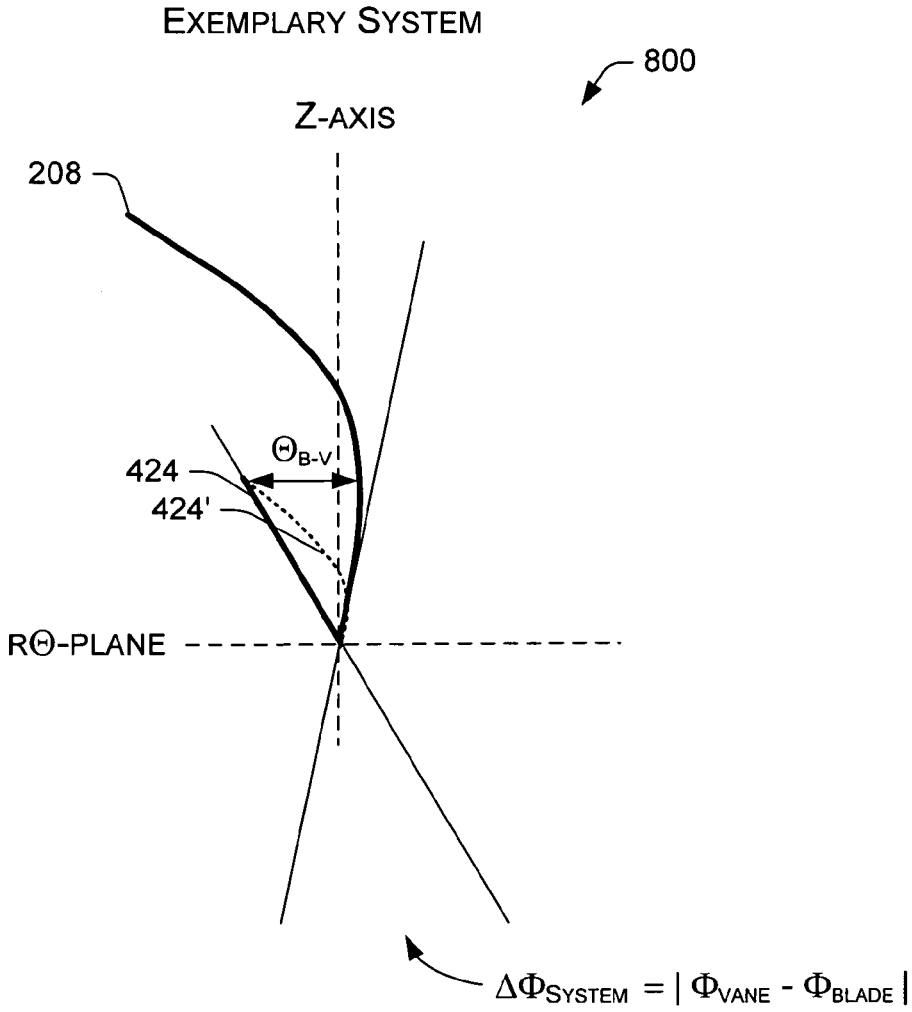
FIG. 8 is a plot of the traditional outer edge of FIG. 4A and the exemplary inner edge of FIG. 6B.

FIG. 8 shows an exemplary system 800 that includes an exemplary vane having an inner edge 424 and a traditional blade having an outer edge 204, which are suitable for use in an arrangement such as that illustrated in FIG. 2. The exemplary vane inner edge 424 is shown in relation to a z-axis and an re)-plane (e.g., projected onto a plane along the z-axis). The z-axis corresponds to the z-axis of FIG. 2, which is the rotational axis of the turbine wheel 204. The rΘ-plane lies orthogonally to the z-axis at the lowest z value of the exemplary vane inner edge 424. As shown in FIG. 8, the inner edge 424 of the vane forms an angle $\Phi_{Vane}$ with the rΘ-plane (e.g., projected onto a plane along the z-axis). In the exemplary system 700, the angle $\Delta\Phi_{System}$ is typically greater than approximately 15°. For example, given a $\Phi_{Blade}$ value of approximately 50° and a $\Phi_{Vane}$ value of approximately 100°, $\Delta\Phi_{System}$ would be approximately 50°. Further, the $\Theta_{B-V}$ value of the system is greater than or equal to approximately 6°.

FIG. 8 also shows another exemplary vane inner edge 424', which is curved or arcuate. In general, such an exemplary vane inner edge 424' has a concavity oriented in approximately the same direction as the concavity of the blade outer edge or, starting at a lower point on the inner edge, the inner edge first deviates from a vertical axis of turbine wheel rotation (e.g., z-axis) in the direction of rotation and then deviates opposite the direction of rotation. For an arcuate vane or an otherwise concave vane (e.g., V-shaped or other concave shape), the angle $\Phi_{Vane}$ may be approximated using a line passing through the lowest and highest z values of the exemplary vane inner edge 424'.

Figure 9:
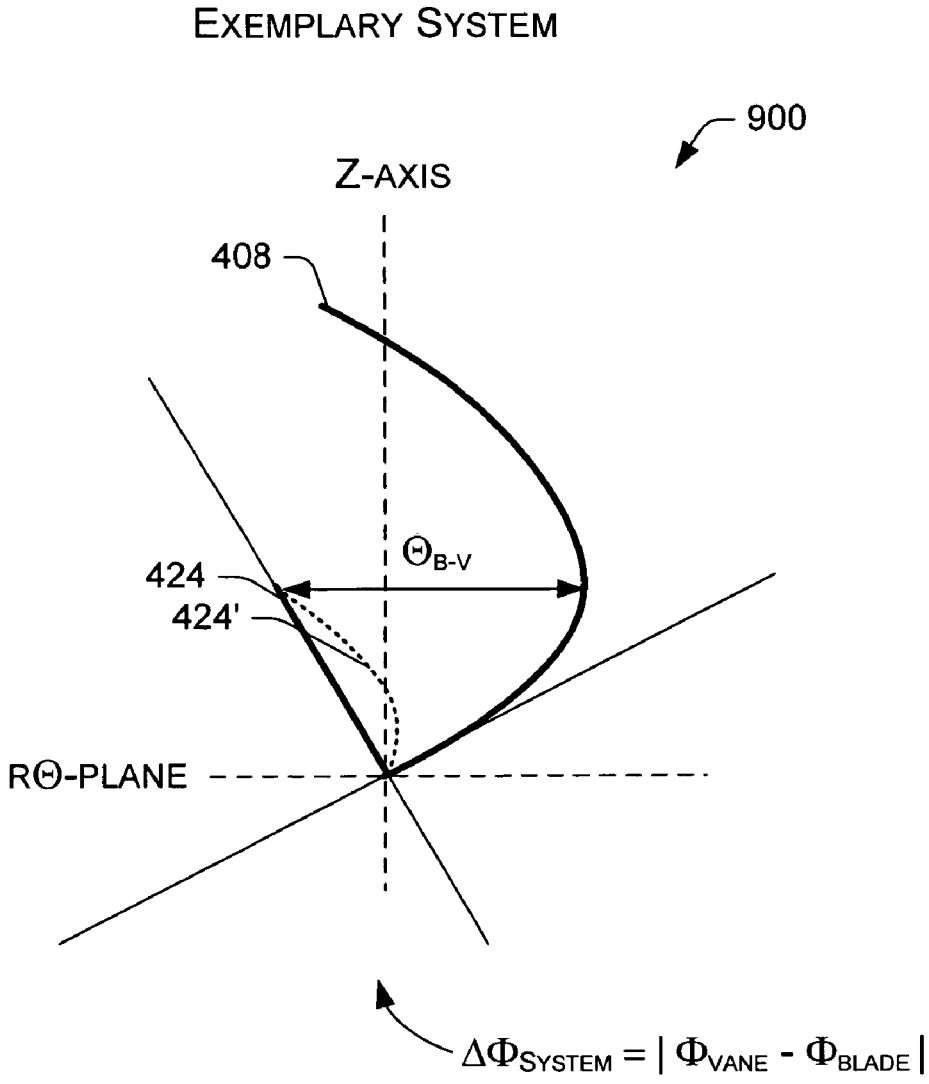
FIG. 9 is a plot of the exemplary outer edge of FIG. 6A and the exemplary inner edge of FIG. 6B.

FIG. 9 shows an exemplary system 900 that includes an exemplary blade having an outer edge 408 and an exemplary vane having an inner edge 424, which are suitable for use in an arrangement such as that illustrated in FIG. 2. The exemplary blade outer edge 408 is shown in relation to a z-axis and an rΘ-plane (e.g., projected onto a plane along the z-axis). The z-axis corresponds to the z-axis of FIG. 2, which is the rotational axis of the turbine wheel 204. The rΘ-plane lies orthogonally to the z-axis at the lowest z value of the exemplary blade outer edge 408. As shown in FIG. 9, the outer edge 408 of the turbine blade forms an angle $\Phi_{Blade}$ with the rΘ-plane (e.g., projected onto a plane along the z-axis). The exemplary vane inner edge 424 is shown in relation to a z-axis and an rΘ-plane. The z-axis corresponds to the z-axis of FIG. 2, which is rotational axis of the turbine wheel 204. The rΘ-plane lies orthogonally to the z-axis at the lowest z value of the exemplary vane inner edge 424. As shown in FIG. 9, the inner edge 424 of the vane forms an angle $\Phi_{Vane}$ with the rΘ-plane (e.g., projected onto a plane along the z-axis). In the exemplary system 900, the angle $\Delta\Phi_{System}$ is typically greater than approximately 40° (e.g., for purposes of illustration, in the exemplary system 900, $\Delta\Phi_{System}$ is approximately 90°, which is greater than approximately 40°). For example, given a $\Phi_{Blade}$ value of approximately 49° (e.g., an increase in the angle from that shown) and a $\Phi_{Vane}$ value of approximately 100°, $\Delta\Phi_{System}$ would be approximately 51°. Further, in this example, the $\Theta_{B-V}$ value of the system is greater than or equal to approximately 33°.

FIG. 9 also shows another exemplary vane inner edge 424', which is curved or arcuate. In general, such an exemplary vane inner edge 424' has a concavity oriented in approximately the same direction as the concavity of the blade outer edge or, starting at a lower point on the inner edge, the inner edge first deviates from a vertical axis of turbine wheel rotation (e.g., z-axis) in the direction of rotation and then deviates opposite the direction of rotation. For an arcuate vane or an otherwise concave vane (e.g., V-shaped or other concave shape), the angle $\Phi_{Vane}$ may be approximated using a line passing through the lowest and highest z values of the exemplary vane inner edge 424'.

Figure 10A:
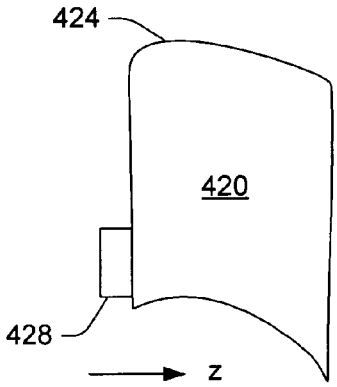
FIGS. 10A-G are various views of an exemplary vane.
Figure 10B:
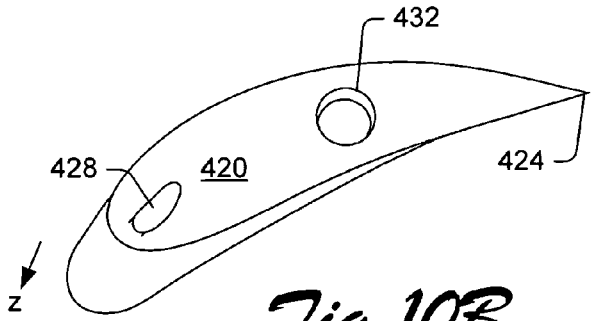
Figure 10C:
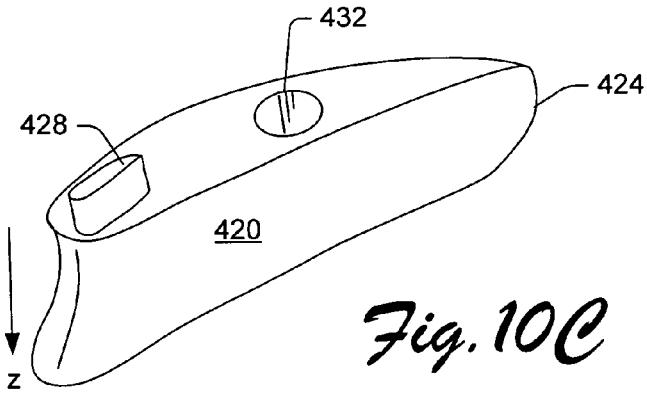
Figure 10D:
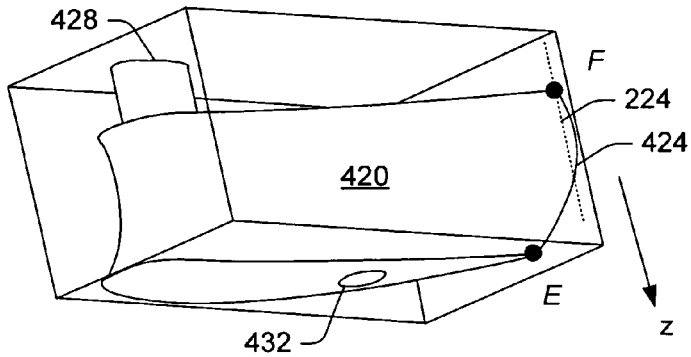
Figure 10E:
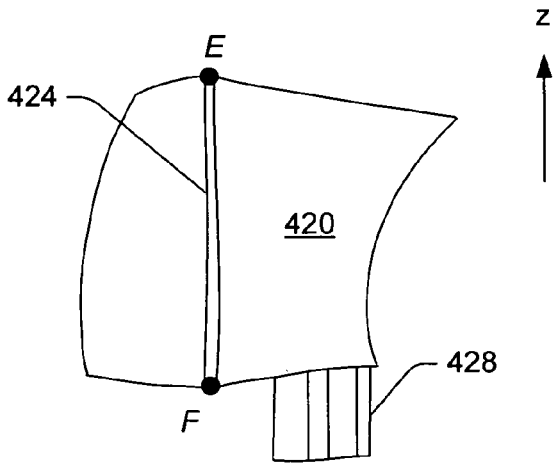
Figure 10F:
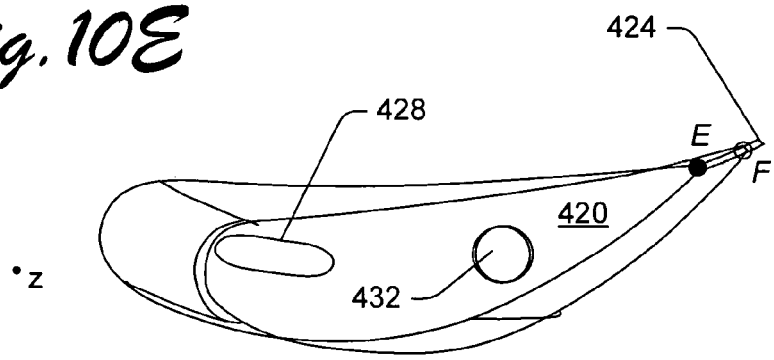
Figure 10G:
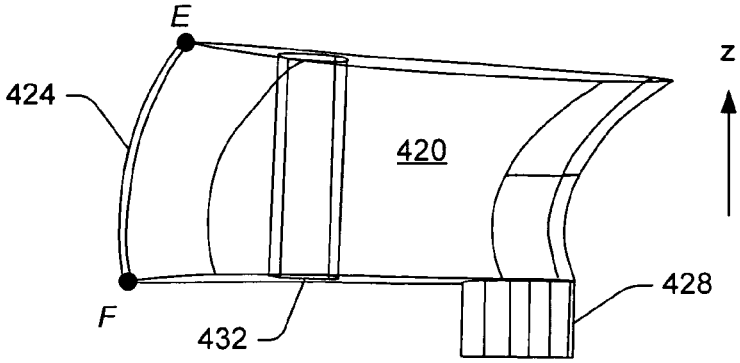

FIGS. 10A, 10B, 10C, 10D, 10E, 10F and 10G show various perspective views of an exemplary vane 420. FIG. 10A shows a side perspective view of the exemplary vane 420 having a prong 428 and an inner edge 424 at the top, wherein the z-axis generally corresponds with an axis of rotation of a turbine wheel. FIG. 10B shows a bottom perspective view of the exemplary vane 420 having an aperture 432 and an inner edge 424 wherein the z-axis generally corresponds with an axis of rotation of a turbine wheel. FIG. 10C shows another bottom perspective view of the exemplary vane 420 having a prong 428, an aperture 432 and an inner edge 424, wherein the z-axis generally corresponds with an axis of rotation of a turbine wheel. FIG. 10D shows a side perspective view of the exemplary vane 420 having a prong 428, an aperture 432 and an inner edge 424. A wire box is also shown around the vane 420. FIG. 10D also shows point E and point F on the inner edge 424. Further, a traditional vane inner edge 224 is shown as a dashed line, which is straight and parallel to the z-axis. FIG. 10E shows a front view or edge on view of the exemplary vane 420 that shows the shape of the inner edge 424 or "trailing edge" of the vane 420. The inner edge 424 shows point E and point F. FIG. 10F shows a top wire frame view of the exemplary vane 420 that includes point E and point F of the inner edge 424; the prong 428 and the aperture 432 are also shown. FIG. 10G shows a side wire frame view of the exemplary vane 420 where point E and point F are shown on the inner edge 424; the prong 428 and the aperture 432 are also shown.

Figure 11:
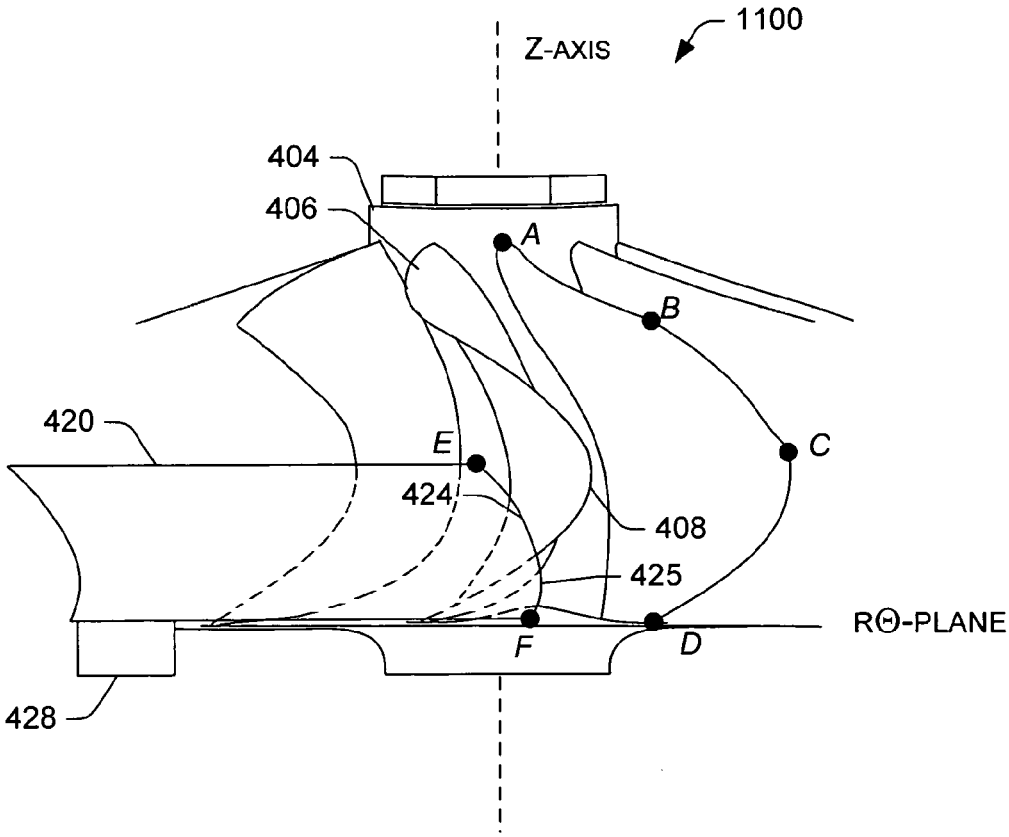
FIG. 11 is a side view of an exemplary turbine and vane system.

FIG. 11 shows a side view of an exemplary system 1100 that includes an exemplary turbine wheel 404 and an exemplary vane 420. This side view is a normal projection, normal for the labeled blade, onto a plane that includes a z-axis which is orthogonal to an rΘ-plane. The turbine wheel 404 includes a plurality of blades 406, wherein each blade has an outer edge 408. As shown, the turbine wheel 404 rotates counterclockwise (according to Θ) about the z-axis. Of course, an exemplary system may be configured to rotate clockwise. The vane 420, which is "stationary" (e.g., except for movement due to a variable geometry mechanism), has an inner edge 424, which is the edge closest to the outer edge of any given turbine blade (e.g., the outer edge labeled 408). The vane 420 also includes a prong 428, which may act as part of, or in conjunction with, a variable geometry mechanism capable of moving the vane. A post for the vane 420 is not shown, and could be positioned fore of the prong 428, i.e., toward the inner edge 424.

In this example, the inner edge 424 of the exemplary vane 420 is not linear, but curved (see, e.g., exemplary vane inner edge 424', above). Thus, the angle $\Phi_{Vane}$ may be defined by the angle formed by the intersection of the rΘ-plane and a line projected onto a plane that includes the z-axis wherein the line includes the lowest z value point and the highest z value point of the inner edge 424. In general, overlap occurs between a blade outer edge and a vane inner edge over the entire z-dimension height of the vane inner edge. The inner edge 424 also has a critical point 425 (e.g., a critical point between point E and point F). In some instances, such a critical point may be used to determine a trailing radial line of a vane inner edge. Generally, the angle $\Phi_{Vane}$ is defined with respect to a high and a low z value for a vane with a curved inner edge.

Of course, the relationship between the vane inner edge 424 and the blade outer edge 408 will change if any adjustment is made to the vane, for example, via a variable geometry mechanism.

Figure 12A:
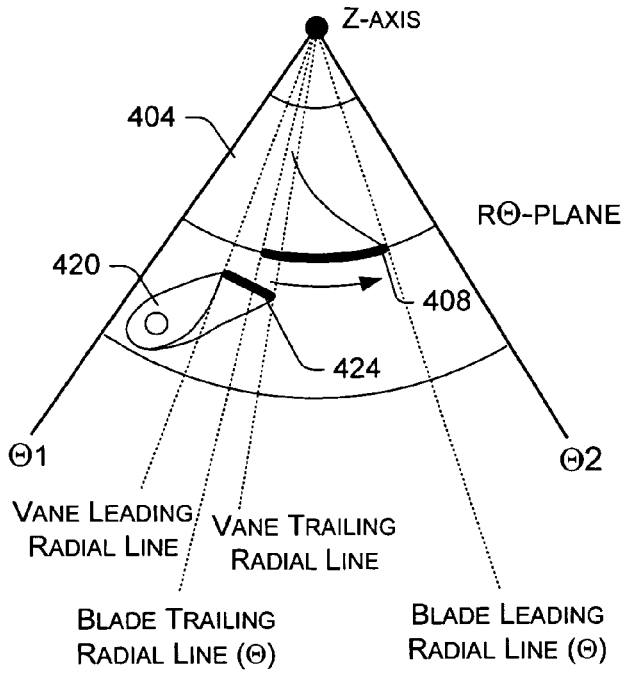
FIG. 12A is a top view of a section of an exemplary turbine wheel and vane system.

FIG. 12A shows an overhead view of a pie-shaped section of an exemplary system 1200 that includes that includes an exemplary turbine wheel 404 and an exemplary vane 420. The angles $\Theta_1$ and $\Theta_2$ lie in an rΘ-plane about a z-axis (out of the page), bound the pie-shaped section and are referenced in a plot of blade-vane overlap versus rotation, Θ, that appears in FIG. 12B.

Figure 12B:
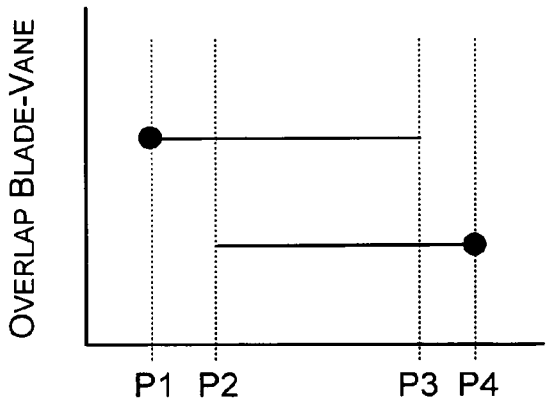
FIG. 12B is a plot of blade outer edge and vane inner edge overlap for various degrees of rotation of the turbine wheel of FIG. 12A.

As shown in FIG. 12A, the vane 420 includes an inner edge 424 having a vane leading radial line and a vane trailing radial line (optionally at a critical point), which are stationary except for any adjustment due to a variable geometry mechanism. The turbine wheel 404 includes a blade outer edge 408 having a blade leading radial line and a blade trailing radial line, which rotate according to Θ in the rΘ-plane (as shown in the plot of FIG. 12B). Of course, when choosing a leading or trailing radial line of a blade, points on the outer edge of the blade having z values greater than those of a corresponding vane are generally not considered since no overlap exists between such points and the inner edge of the corresponding vane.

As the turbine wheel 404 rotates in a counter-clockwise direction Θ, from $\Theta_1$ toward $\Theta_2$, while the vane 420 remains stationary, the blade leading radial line meets the vane leading radial line, which corresponds to the point P1 in the plot of FIG. 12B. At P1, an overlap exists between the leading radial line of the inner edge of the vane 424 and the outer edge of the blade 408. As the wheel 404 continues to rotate toward $\Theta_2$, the leading radial line of the blade eventually meets the trailing radial line of the vane, which corresponds to point P2 in the plot of FIG. 12B. In this example, as the wheel 404 continues to rotate toward $\Theta_2$, the trailing radial line of the blade eventually meets the leading radial line of the vane, which corresponds to point P3 in the plot of FIG. 12B. At P3, there is no longer any overlap between the leading radial line on the inner edge 424 of the vane 420 and the outer edge 408 of the turbine blade. Finally, at P4, any overlap ceases to exist when the trailing radial line of the outer edge of the blade passes the trailing radial line of the vane. Of course, as shown in FIG. 11, the trailing radial line of the vane may correspond to a critical point. Hence, overall, an angle (in rΘ coordinates) of overlap $\Theta_{Overlap}$ may be defined as the difference between Θ)(P1)−Θ (P4). Further, the sum of $\Delta\Theta_{Blade}$ and $\Delta\Theta_{Vane}$ may approximate $\Theta_{Overlap}$, where $\Delta\Theta_{Blade}$ is the difference between the blade trailing radial line and the blade leading radial line and $\Delta\Theta_{Vane}$ is the difference between the vane trailing radial line and the blade leading radial line. The values $\Delta\Theta_{Blade}$ and $\Delta\Theta_{Vane}$ may be approximated from a plot of Θ versus height of blade or vane along the z-axis as shown in FIG. 13A, discussed below. Of course, the relevant $\Delta\Theta_{Blade}$ value will typically be limited to the height of a corresponding vane.

FIGS. 12A and 12B illustrate a manner of reducing noise generated by blade and vane interactions by dispersing the interactions over an increased angle of rotation of a turbine wheel. In addition, FIGS. 12A and 12B demonstrate that various exemplary devices, systems and/or methods of noise reduction may be characterized according to dynamic variables. For example, an exemplary system for noise reduction includes a vane having an inner edge and a blade, on a turbine wheel, having an outer edge wherein an overlap exists between at least a part of these two edges for more than approximately 6° rotation of the blade about the turbine wheel's axis of rotation (e.g., in rΘ coordinates). In essence, the "dispersed" overlap between the vane and the blade acts to reduce shock and/or pressure disturbances caused by interactions between a vane and a rotating blade. Further note that the value $\Theta_{B\text{-}V}$ discussed above is a static blade and vane system parameter that approximates $\Theta_{Overlap}$.

Accordingly, an exemplary method of reducing noise in a variable geometry turbine includes directing flow to a turbine wheel of the variable geometry turbine using a plurality of vanes wherein each vane has an inner edge; rotating a turbine wheel having a plurality of blades about an axis of rotation wherein each blade has an outer edge and wherein each outer edge overlaps one or more points on an inner edge of a vane for greater than approximately 6° of rotation.

Figure 13:
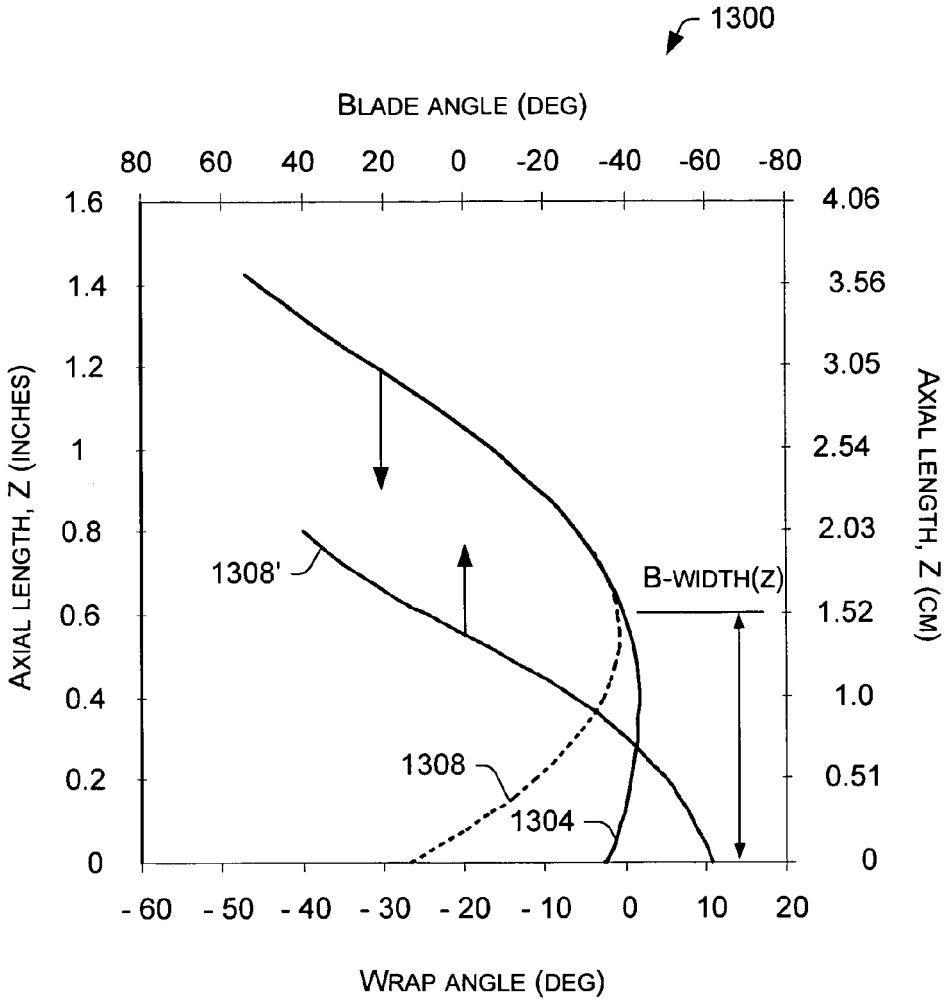
FIG. 13 is a plot of blade height versus wrap angle and blade angle for a traditional turbine blade outer edge and an exemplary turbine blade outer edge.

FIG. 13 shows a plot 1300 of height along a z-axis versus wrap angle and blade angle for a particular traditional blade outer edge 1304 and for an particular exemplary blade outer edge 1308, as described herein. The plot 1300 corresponds to a cylindrical coordinate system having coordinate r, Θ, z. In this particular plot, the z coordinate has dimensions in inches. The wrap angle may be defined with respect to the rΘ-plane wherein the centerline of a given blade has a wrap angle of Θ=0°. Thus, wrap angle corresponds to position of a point on a blade in a cylindrical coordinate system wherein the Θ coordinate is called the wrap angle at that point. As shown, the wrap angle varies with respect to the height of the blade along the z-axis. In the plot 1300, the traditional blade outer edge 1304 has a wrap angle of approximately 0° at z=0 whereas the exemplary blade outer edge 1308 has a wrap angle of approximately −30° at z=0.

The plot 1300 also shows blade angle in degrees for the exemplary blade 1308'. Blade angle (often referred to as β) is the slope of the blade surface relative to axial. The blade angle is related to the wrap angle by the equation: $\tan(\beta)=r*d\Theta/dz$, where r is some radius of interest. In the case of the plot 1100 of FIG. 11, the radius r is at the tip of the wheel. The distance "b-width" shown in the plot 1300 corresponds to a vane height.

For a dynamic blade and vane system, speed of an interaction point between a blade and a vane may be used to characterize the system. Mach number is typically defined as speed divided by speed of sound, which is approximately 330 meters per second in air at standard conditions. In general, a Mach number having an absolute value greater than unity may be considered "supersonic" while an absolute value less than unity may be considered "subsonic". Pressure disturbances produced by an object traveling in a medium, such as air, normally travel at the speed of sound; however, when an object travels at speeds greater than the speed of sound, a pressure disturbance does not travel ahead of the object and a shockwave results. Noise generated by an object traveling at a speed greater than the speed of sound is typically greater than noise generated by an object traveling less than the speed of sound due to shockwave generation.

Referring again to the exemplary system 1100 of FIG. 11, wherein an outer edge of a turbine blade passes a stationary inner edge of a vane, a Mach number may be defined based on the speed of an intersection point between the outer edge of the blade and the inner edge of the vane. For example, as the outer edge segment from point C to point D passes the inner edge segment from point E to point F, at least one intersection point may be defined, and, for various exemplary systems, one main intersection point may be defined. In the exemplary system 1100, the intersection point moves from a higher position with respect to the z-axis to a lower position with respect to the z-axis. The speed of the intersection point may also vary as it moves from the higher position to the lower position. In general, various exemplary blades, vanes and/or systems thereof, aim to reduce the speed of an interaction point. In particular, various exemplary blades, vanes and/or systems thereof aim to reduce the interaction speed and to maintain a subsonic interaction point speed over as much of the interaction as may be suitably implemented.

In an example, consider a traditional system having a blade outer edge on a turbine wheel having a radius, r, wherein the outer edge has an azimuthal angle, $\Theta_{lt}$ (e.g., in cylindrical coordinates), of approximately 6° between a leading point (e.g., along a leading radial line) and a trailing point (e.g., along a trailing radial line) wherein the leading point is at a height, $z_l$ and the trailing point is at a height $z_t$ along the z-axis. Also consider a traditional vane having a vertical inner edge having a height of approximately $z_l$ (e.g., corresponding to the leading point of the outer edge of the blade). In this example, the inner edge of the vane may be viewed as a stationary vertical line and an intersection point may move from point $z_l$ of the outer edge of the blade to point $z_t$ of the outer edge of the blade as the outer edge of the blade passes the inner edge of the stationary vane. The interaction will last for a time Δt, which may be approximated by the arc length for an arc of approximately 6° divided by rotational speed of the blade. For example, given a rotational speed, $v_{rps}$, of 2,000 revolutions per second, an interaction time is approximately 2πr/60 divided by 2πr*(2000 rps), which is approximately $8.3\times10^{-6}$ s and does not depend on radius of the turbine wheel. In this example, the interaction point traverses a distance, $d_p$, that may be approximated by the hypotenuse of a triangle having a vertical segment of $z_l-z_t$ and a horizontal segment equal to the arc length wherein $d_p^2$ equals $(z_l-z_t)^2+(2\pi r/60)^2$. In this instance, $d_p$ depends on r, $z_l$ and $z_t$, which for purposes of illustration may be assumed to be approximately 0.04 m, 0.01 m and 0 m, respectively. Accordingly, in this example, $d_p$ is approximately 0.011 m. Hence, the interaction point has an average speed, $Vp_{ave}$, of approximately $d_p$ divided by Δt or approximately 1300 meters per second (e.g., over four times the speed of sound in air at standard conditions). To summarize, in this example, the average speed of the interaction point $Vp_{ave.}$ may be approximated by the following equation:

$$Vp_{ave.}=[((z_l-z_t)^2+(2\pi r*(\Theta_{lt}/360°))^2)^{0.5}]/(\Theta_{lt}/(v_{rps}*360°))$$

Thus, a decrease in $Vp_{ave.}$ may occur for (i) a decrease in $(z_l-z_t)$; (ii) a decrease in $v_{rps}$; (iii) a decrease in r; and/or for practical decreases in $\Theta_{lt}$. With respect to $\Theta_{lt}$, an increase to approximately 12° results in a $Vp_{ave.}$ that is approximately 60% of the value for 6°, an increase to approximately 24° results in a $Vp_{ave.}$ that is approximately 45% of the value for 6°, and an increase to approximately 36° results in a $Vp_{ave.}$ that is approximately 42% of the value for 6°.

An exemplary method includes selecting parameters for a turbine wheel blade (e.g., r, $z_l$, $z_t$, $v_{rps}$, etc.) and adjusting an azimuthal angle between a leading point on an outer edge of the blade and a trailing point on the outer edge of the blade (e.g., $\Theta_{lt}$) to achieve a suitable average speed for an interaction point (e.g., $Vp_{ave.}$).

Figure 14:
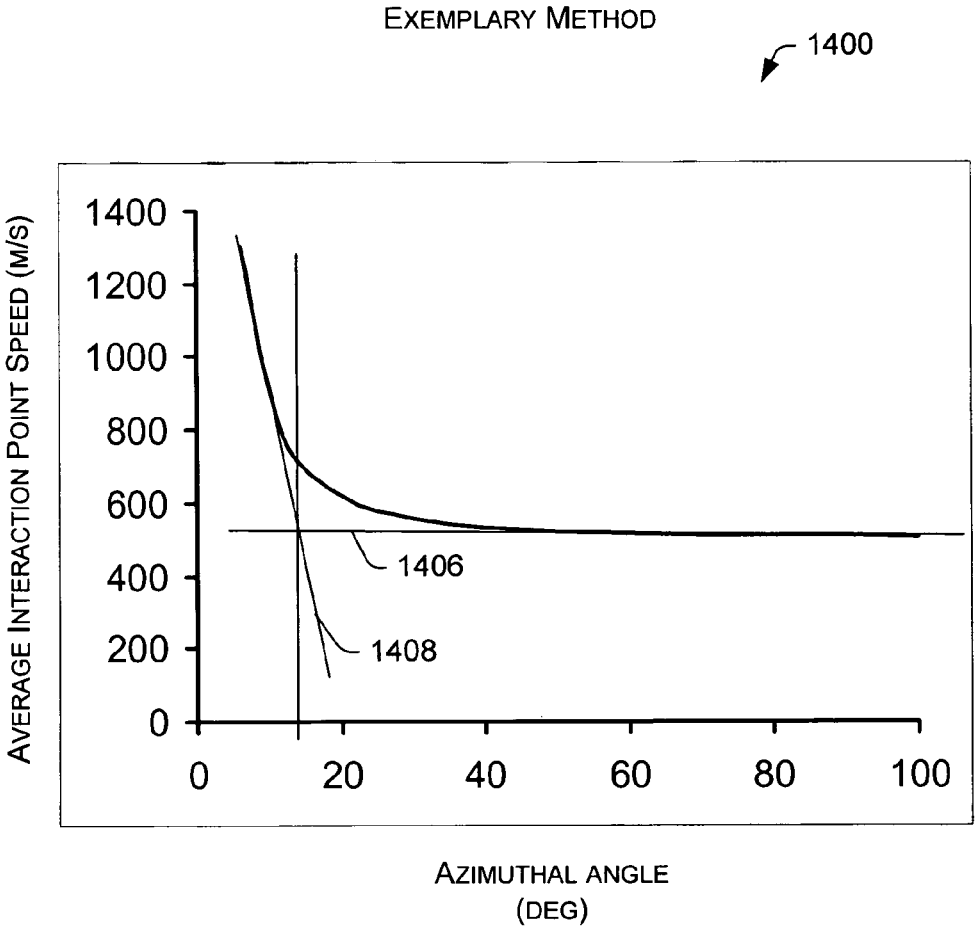
FIG. 14 is a plot of speed of an interaction point versus azimuthal angle.

FIG. 14 shows a plot of speed of an interaction point versus azimuthal angle 1400. In general, a plot of $Vp_{ave.}$ versus angle (e.g., $\Theta_{lt}$) will exhibit two regions wherein each region may be approximated by a line (e.g., using statistical methods, such as linear regression, etc.). Accordingly, an exemplary method selects an angle based on such information. For example, an exemplary method may select an angle based on an intersection point between the two lines (e.g., lines 1406, 1408) or within an offset from the intersection (e.g., a positive offset, etc.). Of course, other analytical techniques may be used to select an appropriate angle based on knowledge of $Vp_{ave.}$ versus angle.

Of course, a similar type of analysis may be performed for a vane disposed at a vane angle $\Phi_{Vane}$. For example, given a constant vane height equal to $(z_l-z_t)$, as described above, an increase in $\Phi_{Vane}$ to an angle greater than approximately 90° will have the effect of increasing the interaction time Δt and hence lowering the average interaction point speed (e.g., $Vp_{ave.}$). Given a constant inner edge vane height, an increase in $\Phi_{Vane}$ will correspond to an increase in overall length of the vane inner edge. If the vane inner edge is assumed to form the hypotenuse of a right triangle, then the base of the triangle may approximate an arc length, which in turn may approximate an angle, $\Delta\Theta_{lt}$ which may be added to $\Theta_{lt}$. Again, in this example, the angle $\Delta\Theta_{lt}$ will have the effect of increasing Δt. The base of the triangle may be approximated by the height of the inner edge of the vane times the tangent of $\Phi_{Vane}$ minus 90° (e.g., $(z_l-z_t)*\tan(\Phi_{Vane}-90°)$). Accordingly, the angle $\Delta\Theta_{lt}$ is approximately 360° $*((z_l-z_t)/2\pi r)*\tan(\Phi_{Vane}-90°)$. Given the parameters corresponding to the plot of FIG. 14, an increase in $\Phi_{Vane}$ from approximately 90° to approximately 100° decreases the average interaction point speed by approximately 30% for a $\Theta_{lt}$ of approximately 6° and approximately 10% for a $\Theta_{lt}$ of approximately 20°.

Therefore, to effectuate a reduction in the average speed of an interaction point, an exemplary turbine wheel blade includes an azimuthal angle, in cylindrical coordinates, between a leading point and a trailing point of an outer edge of the blade that may be greater than that of a traditional turbine wheel blade, a vane angle $\Phi_{Vane}$ greater than approximately 90° that may be related to an effective azimuthal angle, and/or a combination of both. Thus, as described herein, an exemplary system may include an exemplary blade and an exemplary vane, an exemplary blade, or an exemplary vane.

Figure 15A:
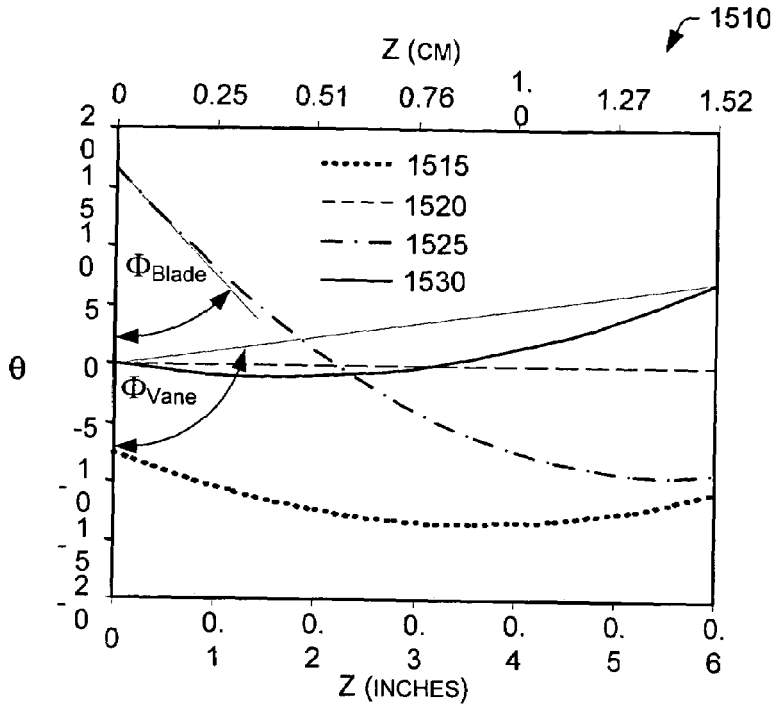
FIG. 15A is a plot of angle $\Theta$ versus a normalized axial dimension z.

FIG. 15A shows an exemplary plot 1510 of angle θ (in a cylindrical coordinate system having coordinates r, Θ, z) versus a z value (an axial value in the direction of the axis of a turbine wheel where the lowest point of a blade outer edge corresponds to a z value of approximately 0 in. or approximately 0 cm and an uppermost point of a blade outer edge corresponds to a z value of approximately 0.6 in. or approximately 1.5 cm). In this particular plot, the angle Θ) increases in a counter-clockwise manner, i.e., opposite the direction of rotation of a turbine blade. The plot 1510 includes data for a traditional blade outer edge 1515, a traditional vane inner edge 1520, an exemplary blade outer edge 1525 and an exemplary vane inner edge 1530. According to the plot 1510, the angle Θ=0° corresponds to the lowest z values of the inner edge of the traditional vane (data 1520) and the inner edge of the exemplary vane (data 1530). Note that the angle Θ for the traditional vane inner edge 1520 does not vary with respect to z value while the exemplary vane inner edge 1530 initially deviates from Θ=0° in the direction of blade rotation and then deviates from Θ=0° in opposite the direction of blade rotation. The outer edge data for the traditional blade 1515 and the exemplary blade 1525 are based on a common z-dimension, for example, that corresponds to a z-dimension vane height. According to the plot 1510, in use, the traditional or the exemplary blade would rotate in a clockwise direction past the traditional or the exemplary vane.

The plot 1510 also shows approximate angles $\Phi_{Blade}$ and $\Phi_{Vane}$ for the exemplary blade and the exemplary vane. The approximate angle for $\Phi_{Blade}$ is defined by the initial slope (or tangent) of the Θ versus z curve while the approximate angle for $\Phi_{Vane}$ is defined by a line passing through the highest and lowest z values of the exemplary vane and its intersection with the ordinate axis (e.g., the Θ axis of the plot 1510 at z=0). In this example, the angle $\Phi_{Blade}$ is approximately 45° and the angle $\Phi_{Vane}$ is approximately 100° (based on lowermost z and uppermost z points). Thus, a system that includes the exemplary blade and vane would have a $\Delta\Phi$ of approximately 55°. Further, this system would have a $\Theta_{B-V}$ value of approximately 30°.

As mentioned above, the sum of $\Delta\Theta_{Blade}$ and $\Delta\Theta_{Vane}$ may approximate $\Theta_{Overlap}$, where $\Delta\Theta_{Blade}$ is the difference between the blade trailing radial line and the blade leading radial line and $\Delta\Theta_{Vane}$ is the difference between the vane trailing radial line and the blade leading radial line. According to the plot 1510 of FIG. 15A, $\Delta\Theta_{Blade}$ is approximately 25° and $\Delta\Theta_{Vane}$ is approximately 7°; thus, $\Theta_{Overlap}$ is approximately 32°.

Figure 15B:
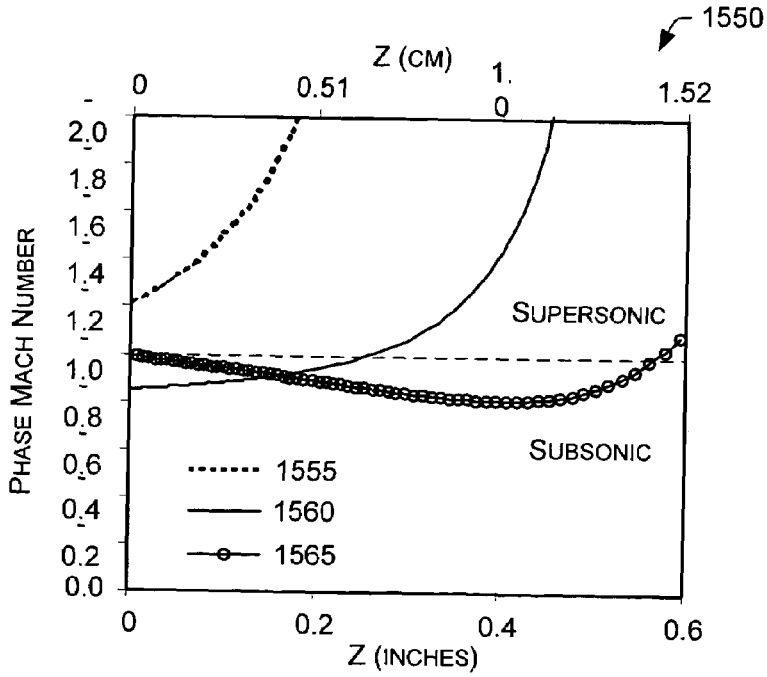
FIG. 15B is a plot of phase Mach number versus a normalized axial dimension z.

FIG. 15B shows a plot 1550 of phase Mach number versus z value (in cm and in.) for several blade and vane combinations at a turbine wheel rotational speed of approximately 120,000 rpm. In these examples, the turbine wheels have a diameter of approximately 0.0725 m (e.g., radius of approximately 0.03125 m) and hence, at 120,000 rpm, a speed at the radius of approximately 393 meters per second. Further, in these examples, the vane height is approximately 0.6 inches (e.g., approximately 0.015 m).

Referring again to the plot 1550 of FIG. 15B, a region above Mach number −1.0 corresponds to supersonic speeds while a region below Mach number −1.0 corresponds to subsonic speeds. In the plot 1550, data are shown for a traditional blade and a traditional vane 1555, a particular exemplary blade and a traditional vane 1560 and a particular exemplary blade and a particular exemplary vane 1565. The data 1555 indicate that interaction point speeds for the traditional blade and traditional vane are supersonic. The data 1560 indicate that interaction point speeds for the exemplary blade and traditional vane are both subsonic and supersonic (e.g., having a transition at a z-dimension of approximately 0.25 in. (approx. 0.6 cm), which is a z-dimension greater than approximately one-third of the vane height). The data 1565 indicate that interaction point speeds for the exemplary blade and exemplary vane are predominantly subsonic for a z value less than approximately the vane height. For example, the data 1565 indicate that an exemplary blade and an exemplary vane may provide for a subsonic interaction point speed over more than approximately 90% of the vane inner edge and blade outer edge overlap. Overall, the data presented in the plots 1510, 1550 of FIGS. 15A and 15B indicate that interaction point speed depends on local angles. Further, the combination of an exemplary blade outer edge and an exemplary vane inner edge can optionally provide for subsonic interaction point speeds along the entire vane height.

In addition, the exemplary system represented by the data 1565, demonstrates that an exemplary blade and an exemplary vane may be used to reduce Mach number variability for an interaction. For example, the average Mach number for the data 1565 (e.g., between z=0 in. and z=0.6 in.) is approximately −0.9. In this example, the Mach number, as a function of z, does not deviate greatly from the average. In particular, the Mach number falls within a range of approximately −1.1 to approximately −0.8 (e.g., less than approximately +/−15%). Hence, an exemplary system may maintain a Mach number for an interaction that does not vary more than 15% from an average Mach number for the interaction. Further, considering the data 1560 for an exemplary blade and traditional vane system, an exemplary system may maintain a subsonic Mach number for part of an interaction. Yet further, an exemplary system may maintain a subsonic Mach number for at least approximately one-third of an interaction, for example, defined by the height of a vane. In these examples, parameters may be varied to make suitable comparisons between the examples or other exemplary blades, exemplary vanes or exemplary systems and traditional blades, vanes and/or systems.

Figure 16A:
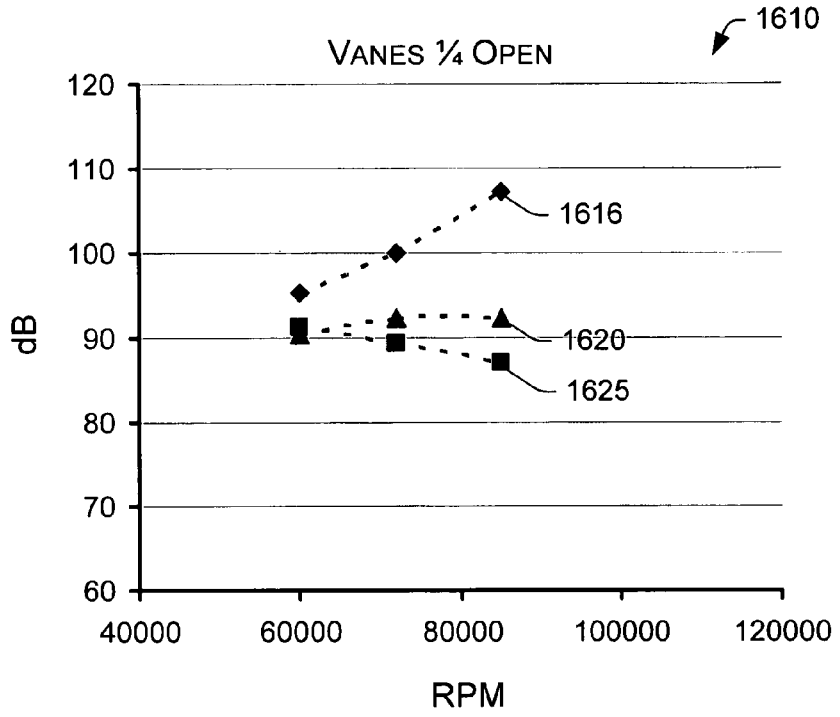
FIG. 16A is a plot of noise in decibels (dB) versus revolutions per minute (rpm) for various turbine and vane systems having vanes adjusted to one-quarter open.

FIG. 16A shows a plot 1610 of noise level in decibels (dB) versus turbine wheel rotational speed in revolutions per minute (rpm) for three systems wherein the vanes are positioned at one-quarter open (e.g., one-quarter of the full open position). The noise level data are based on averages of at least 5 noise levels from different noise level observation points. The system 1615 corresponds to a traditional blade having a $\Phi_{Blade}$ of approximately 63° and a traditional vane having a $\Phi_{Blade}$ of approximately 90° (e.g., $\Delta\Phi_{System}$ of approximately 27°). Noise level in the traditional system 1615 increases with respect to an increase in rotational speed. More specifically, a greater than 10 dB increase in noise occurs over an increase in rotational speed from approximately 60,000 rpm to approximately 85,000 rpm.

The system 1620 corresponds to an exemplary blade having a $\Phi_{Blade}$ of approximately 33° and a traditional vane having a $\Phi_{Blade}$ of approximately 90° (e.g., $\Delta\Phi_{System}$ of approximately 57°). Noise level in the exemplary system 1620 increases only slightly with respect to an increase in rotational speed. More specifically, a less than 5 dB increase in noise occurs over an increase in rotational speed from approximately 60,000 rpm to approximately 85,000 rpm. Further, at all rotational speeds, the noise level is less than that of the traditional system 1615.

The system 1625 corresponds to an exemplary blade having a $\Phi_{Blade}$ of approximately 20° and an exemplary vane having a $\Phi_{Blade}$ of approximately 117° (e.g., $\Delta\Phi_{System}$ of approximately 97°). Noise level in the exemplary system 1625 decreases with respect to an increase in rotational speed. More specifically, an approximate 5 dB decrease in noise occurs over an increase in rotational speed from approximately 60,000 rpm to approximately 85,000 rpm. Further, at all rotational speeds, the noise level is less than that of the traditional system 1615.

Figure 16B:
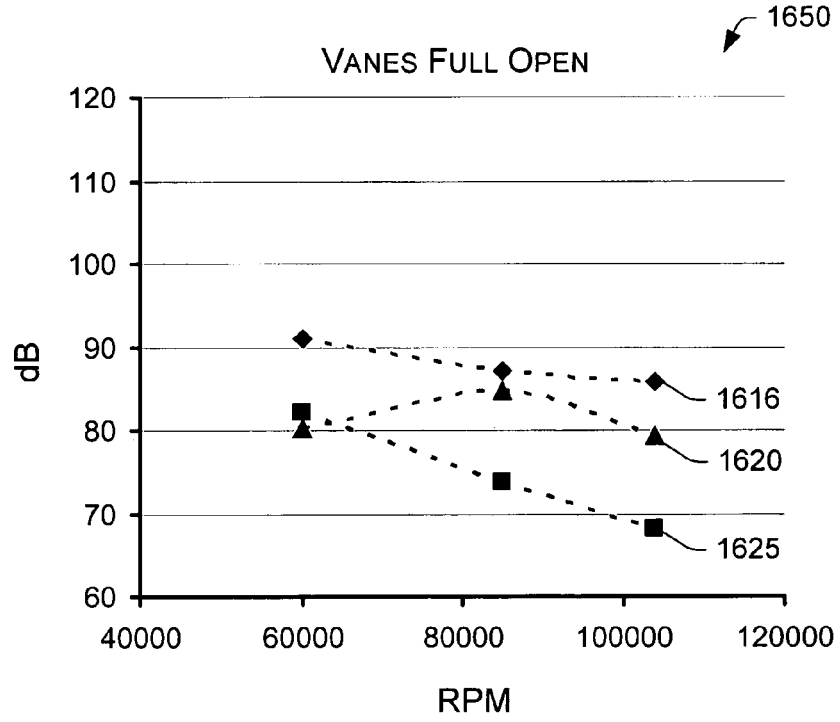
FIG. 16B is a plot of noise in decibels (dB) versus revolutions per minute (rpm) for various turbine and vane systems having vanes adjusted to fully open.

FIG. 16B shows a plot 1650 of noise level in decibels (dB) versus turbine wheel rotational speed in revolutions per minute (rpm) for the three systems of the plot 1610 wherein the vanes are positioned full open. The noise level data are based on averages of at least 5 noise levels from different noise level observation points. Noise level in the traditional system 1615 decreases slightly with respect to an increase in rotational speed. More specifically, an approximate 5 dB decrease in noise occurs over an increase in rotational speed from approximately 60,000 rpm to approximately 105,000 rpm.

Noise level in the exemplary system 1620 increases only slightly with respect to an increase in rotational speed. More specifically, a less than 5 dB increase in noise occurs over an increase in rotational speed from approximately 60,000 rpm to approximately 105,000 rpm. However, at all rotational speeds, the noise level is less than that of the traditional system 1615.

Noise level in the exemplary system 1625 decreases with respect to an increase in rotational speed. More specifically, an approximate 10 dB decrease in noise occurs over an increase in rotational speed from approximately 60,000 rpm to approximately 105,000 rpm. Further, at all rotational speeds, the noise level is less than that of the traditional system 1615.

An exemplary method of reducing noise includes providing a plurality of vanes wherein each vane has an inner edge; using the plurality of vanes to direct exhaust to a turbine wheel and to thereby rotate the turbine wheel about an axis wherein the turbine wheel includes a plurality of turbine blades, wherein each blade has an outer edge and wherein each outer edge overlaps with an inner edge of one of the plurality of vanes for at least 6° of rotation of the turbine wheel about the axis.

Another exemplary method of reducing noise comprising includes providing a plurality of vanes wherein each vane has an inner edge; using the plurality of vanes to direct exhaust to a turbine wheel and to thereby rotate the turbine wheel about an axis wherein the turbine wheel includes a plurality of turbine blades, wherein each blade has an outer edge and wherein during rotation of the turbine wheel each outer edge overlaps with an inner edge of one of the plurality of vanes to thereby form an interaction point; and maintaining a subsonic speed for the interaction point over at least one-third of the vane inner edge. Of course, such an exemplary method optionally includes an interaction point that exists for at least 6° of rotation of the turbine wheel about the axis.

Various exemplary method discussed include selecting one or more dynamic parameters related to operation of a turbine and vane system and, given the one or more dynamic parameters, adjusting one or more static parameters of the turbine and vane system to allow for a subsonic speed for an interaction point between a blade outer edge and a vane inner edge. Of course, one may select static parameters and then adjust dynamic parameters or select a combination of dynamic and/or static parameters and adjust various parameters accordingly. Exemplary static parameters include angles, radiuses, vane heights, etc. Exemplary dynamic parameters include exhaust flow, rotational speed, etc. Such exemplary methods optionally aim to achieve a subsonic speed for the interaction point exists over at least one-third of a vane inner edge.

Various exemplary turbine blade outer edges, exemplary vane inner edges, exemplary systems and exemplary methods help to reduce noise in variable geometry turbines and optionally other turbines wherein a turbine blade interacts with an object.

Although some exemplary methods, devices and systems have been illustrated in the accompanying Drawings and described in the foregoing Detailed Description, it will be understood that the methods and systems are not limited to the exemplary embodiments disclosed, but are capable of numerous rearrangements, modifications and substitutions without departing from the spirit set forth and defined by the following claims.

What is claimed is:

1. A turbine wheel that comprises a plurality of turbine blades wherein each turbine wheel blade comprises:

an inducer portion outer edge that extends from a lowermost point at a backdisc of the turbine wheel and that forms an angle of less than 50° with a rotational plane of the backdisc wherein an angle of 0° corresponds to direction of rotation of the backdisc in the rotational plane;

wherein the angle is defined by a line tangent to the inducer portion outer edge at the lowermost point;

wherein the inducer portion outer edge has a critical point; and wherein the critical point and the lowermost point are separated by at least 26° in the rotational plane to thereby, during rotation of the turbine wheel, reduce noise generated by the inducer portion of the outer edge as it passes by an edge of a vane that directs exhaust to the inducer portion of the outer edge.

2. A turbocharger turbine wheel comprising:

a backdisc and a hub extending from the backdisc;

an axis of rotation; and a plurality of blades wherein each blade comprises an inducer portion outer edge that extends from a lower axial position at the backdisc to an upper axial position, wherein the wrap angle of the outer edge is approximately −26° at the lower axial position and wherein the inducer portion outer edge of each blade comprises a critical point wherein the critical point and the lower axial position are separated by at least 26° about the axis of rotation to thereby, during rotation of the turbine wheel, reduce noise generated by the inducer portion of the outer edge as it passes by an edge of a vane that directs exhaust to the inducer portion of the outer edge.

3. The turbine wheel of claim 2 wherein the critical point has a wrap angle of approximately 0°.

4. The turbine wheel of claim 2 wherein the outer edge has a wrap angle less than −26° at the upper axial position.

5. A turbocharger turbine wheel comprising:

a backdisc and a hub extending from the backdisc;

an axis of rotation; and a plurality of blades wherein each blade comprises an inducer portion outer edge that extends from a lower axial position at the backdisc to an upper axial position, wherein the blade angle is approximately −60° at the lower axial position, wherein the inducer portion extends from the lower axial position to a critical point and wherein the critical point and the lowermost point are separated by at least 26° about the axis of rotation to thereby, during rotation of the turbine wheel, reduce noise generated by the inducer portion of the outer edge as it passes by an edge of a vane that directs exhaust to the inducer portion of the outer edge.

* * * * *